United States Patent [19]

Magro

[11] Patent Number: 4,630,664

[45] Date of Patent: Dec. 23, 1986

[54] INSULATED ROLL-UP DOOR

[76] Inventor: Sebastian Magro, 78-47 75th St., Glendale, N.Y. 11385

[21] Appl. No.: 594,296

[22] Filed: Mar. 28, 1984

[51] Int. Cl.[4] ..... E06B 9/10

[52] U.S. Cl. ..... 160/232; 160/236

[58] Field of Search ..... 160/232, 235, 236

[56] References Cited

U.S. PATENT DOCUMENTS

| | | | |
|---|---|---|---|
| 1,013,945 | 1/1912 | McCloud | 160/232 |
| 1,872,652 | 8/1932 | Best | 160/232 |
| 4,436,136 | 3/1984 | Downey | 160/232 |
| 4,470,444 | 9/1984 | Riexinger et al. | 160/235 |

FOREIGN PATENT DOCUMENTS

| | | | |
|---|---|---|---|
| 2109838 | 9/1972 | Fed. Rep. of Germany | 160/236 |
| 2729235 | 1/1979 | Fed. Rep. of Germany | 160/235 |
| 2808177 | 8/1979 | Fed. Rep. of Germany | 160/235 |
| 2925635 | 1/1981 | Fed. Rep. of Germany | 160/236 |
| 1510588 | 1/1968 | France | 160/235 |

*Primary Examiner*—Ramon S. Britts
*Assistant Examiner*—David M. Purol
*Attorney, Agent, or Firm*—Goodman & Teitelbaum

[57] ABSTRACT

A roll-up door formed of a plurality of elongated adjoining slats connected together by continuous hinges so as to permit the roll-up door to maintain a vertical planar arrangement to provide a closed position, and to roll up along an arcuate track arrangement for storage of the door to provide an opened position. Elongated insulating sleeves are coextensively insertable along each slat for receiving insulation material therein. At opposing sides of the insulating sleeves are suitable connecting arms for engagement with an associated one of the continuous hinges to retain the insulating sleeves in position along the slats without interferring with the hinged movements of the slats between the opened and closed positions.

11 Claims, 8 Drawing Figures

INSULATED ROLL-UP DOOR

BACKGROUND OF THE INVENTION

This invention relates to a roll-up door, and more particularly to a roll-up door having improved means for insulating the door.

Roll-up doors are regularly utilized in connection with garage doors, store front gates, truck doors, and the like. Typically, such roll-up doors include a series of adjoining slats which are hingedly interconnected. In its closed position, the door provides a generally vertical wall. The opposing side edges of the door ride in tracks which extend arcuately upward into a usually hidden recess along the roof of the structure. When the door is lifted, the slats pivot with respect to each other about the connecting hinges, and cause the door to roll along the arcuate track so that it moves from its vertically closed position into the hidden recess. Since the roll-up door is generally utilized as the outer closure of the housing, garage, truck, or the like, it is generally provided with some form of insulation to prevent energy loss. Typically, such insulation is added to the door slats after the door has been assembled. The insulation can be of the foam type which is sprayed on or applied in block form. In many cases, the slats themselves are formed with hollow recesses in order to accommodate such insulation.

Since roll-up doors come in various sizes and shapes, it is generally desirable to formulate these doors out of individual slats which can then be assembled as needed so as to provide the desired size and shape. Accordingly, any additional components, such as the insulation, etc. which must be added, should also be conveniently provided in a structure such that it can be assembled along with the door itself.

SUMMARY OF THE INVENTION

Accordingly, an object of the present invention is to provide a roll-up door which provides the aforementioned features.

Another object of the present invention is to provide a roll-up door having insulation members which can be insertable along the slats which form the roll-up door.

Another object of the present invention is to provide a roll-up door which can be assembled from individual slats, and includes insulation members which can be inserted co-extensively against each slat, as desired.

A further object of the present invention is to provde a roll-up door having hollow sleeves for receiving insulation members, wherein the hollow sleeves can be co-extensively inserted against each slat.

Still another object of the present invention is to provide a roll-up door with insulation members which can either be snap fit into or can slide along each slat.

Yet another object of the present invention is to provide a roll-up door having insulation members which can be inserted co-extensively against each slat and which includes stop members at the end of the slats.

Briefly, in accordance with the present invention, there is provided a roll-up door including a plurality of elongated, adjoining slats. The slats are hinged together to permit the slats to be oriented in a vertical coplanar arrangement when the door is closed, and permitting the slats to be arcuately pivoted with respect to each other during the rolling up of the door. Elongated insulation members are co-extensively inserted along each slat. On opposing sides of the insulation members, there are provided coupling arrangements for engaging the hinges of the connected slats. At the same time the coupling arrangements prevent the insulation members from interfering with the hinged movement of the slats.

In an embodiment of the present invention, the insulation members are hollow sleeves which can receive insulation material therein. The hollow sleeves include a foot arrangement extending from one edge thereof for wedging beneath the hinge at one side of the slat, and a hook arrangement for overlying the hinge at the opposing side of the slat.

At either one or both end edges of a slat, a stop member can be included. The stop member can be a preshaped L-configuration with one of the legs being coupled to the slat and the other leg being perpendicular thereto so as to close off the end of the slat to retain the insulation.

The aforementioned objects, advantages and features of the present invention will, in part, be pointed out with particularity and will, in part, become obvious from the following more detailed description of the invention, taken in conjunction with the accompanying drawings, which form an integral part thereof.

BRIEF DESCRIPTION OF THE DRAWINGS

In the drawings

In the various figures of the drawings, like references characters designate like parts.

DESCRIPTION OF THE PREFERRED EMBODIMENT

Figure 1:
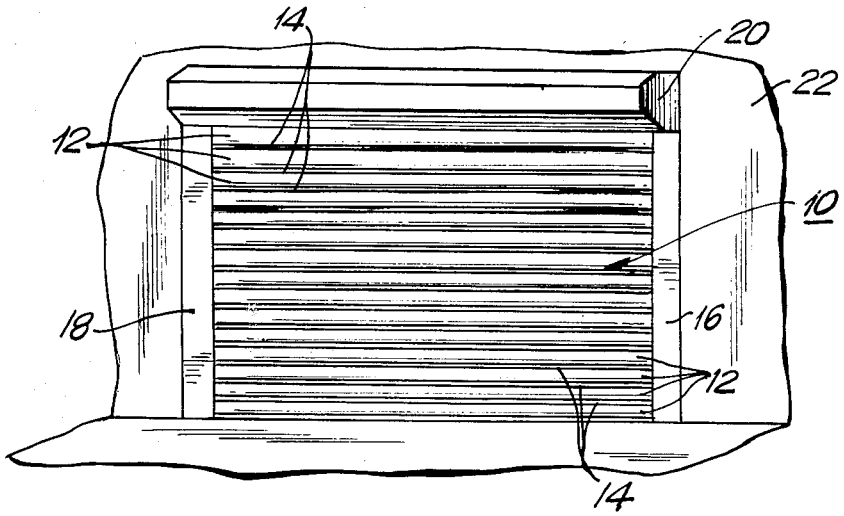
FIG. 1 is a front perspective view of a roll-up door.

Referring now to FIG. 1, there is generally shown a roll-up door 10 formed of a plurality of individual elongated slats 12 generally extending the width of the door. The slats 12 are interconnected by means of a hinge arrangement 14 which connects the slats while permitting pivotal movement therebetween. The ends of the slats 12 are protected by side guard rails 16, 18 in which there are contained conventional track arrangements along which the slats can ride. At the upper end there is a projecting conventional header 20 which contains the necessary mechanism for raising or lowering the door, which is well known in the roll-up door art.

The door 10 can typically be the front of a store 22, a garage, a truck or the like. In its closed position, the slats form a vertical coplanar arrangement for closing the store 22. In order to open the door, it is rolled upward so that each of the slats pivot arcuately with respect to the adjoining slats. The slats run along arcuate tracks for storage in a substantially horizontal recess provided behind the header 20 in a conventional manner known in the art.

Figure 2:
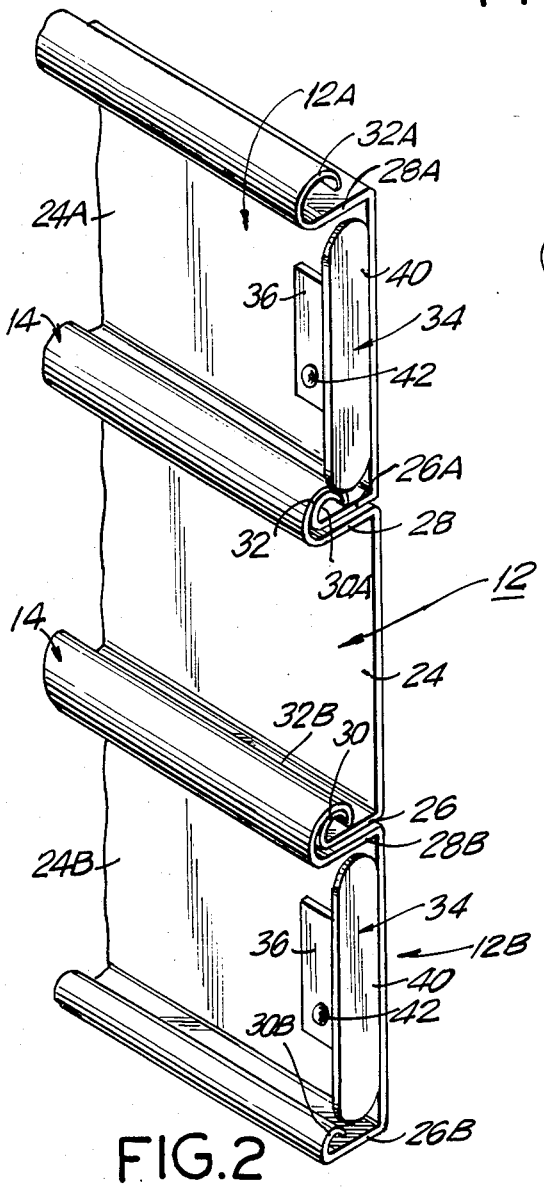
FIG. 2 is a fragmentary perspective view of a few inter-connected slats having end stop members in place.

As shown in FIG. 2, each of the slats 12 of the present invention is formed of a substantially U-shaped channel, including a web portion 24 interconnecting inwardly directed flanges 26, 28. The outer surface of the web 24, together with all other corresponding web portions, constitutes the outer surface of the roll-up door.

At the distal edge of the flange 26 there is provided an upwardly turned, inwardly directed, arcuate segment 30. It should be appreciated that the arcuate segment 30 runs the entire length of the slat 12 and, accordingly, extends the entire width of the roll-up door. The inwardly directed portion of the arcuate segment 30 extends inwardly only partway along the flange 26.

At the distal edge of the flange 28, there is likewise provided an inwardly directed, upwardly turned, arcuate segment 32. Again, this arcuate segment 32 runs the entire length of the slat, and accordingly, extends the width of the roll-up door. The arcuate segment 32 likewise only extends inwardly along a portion of the flange 28.

Both the arcuate segments 30 and 32 are substantially identically curved. However, the arcuate segment 30 has a smaller diameter than does the arcuate segment 32. Accordingly, the arcuate segment 30 can fit within the arcuate segment 32 and can rotate therein.

It should be appreciated, that each of the slats has a configuration corresponding to the hereto described slat 12. For convenience, the adjoining slat vertically above the slat 12 is designated as slat 12A, and corresponding parts of slat 12A are identified with the subscript A. Similarly, the other slat adjoining slat 12 and positioned vertically beneath the slat 12 is designated as slat 12B, and the corresponding parts of slat 12B are designated with the addition subscript B.

Each of the smaller diameter arcuate segments 30, 30A, 30B, . . . all define a hinge pin arrangement. On the other hand, all of the arcuate segments 32, 32A, 32B, . . . constitute a hinge barrel arrangement. In this manner, the hinge pin of one slat, slides into the hinge barrel of the adjoining slat.

More specifically, as shown in FIG. 2, the arcuate segment 30 of the slat 12 constitutes a hinge pin which slides into the hinge barrel 32B of the next adjacent slat 12B. Similarly, the hinge barrel 32 of the slat 12 receives therein the hinge pin 30A of the next adjoining slat 12A on the other side thereof. In this manner, all the slats can be hingedly connected to each other by means of the integral hinge arrangement. Accordingly, the slats are individually formed, and can be assembled to provide the desired height of a particular roll-up door by means of interconnecting a desired number of slats. Similarly, the width of the roll-up door can be provided by properly selecting the length of each slat to extend horizontally across the front of the store or opening to be covered.

The integral hinge arrangement of the present invention permits pivotal rotation of adjoining slats so that they can move from a vertically coplanar position, as shown in FIG. 2, to an arcuate position, as the roll-up door moves along the track arrangements from a closed position to an opened position.

Preferably, insulation is provided against the inner surface of the slats. Such insulation could be sprayed on by means of a foam insulation. Alternately, the insulation could be in strip form with the strips being secured by means of fastening members, adhesives or the like. Occasionally, it is necessary to retain the strip insulation in place by means of a rear covering, such as an additional wall, which would require the rear covering to be attached onto the slats.

Figure 3:
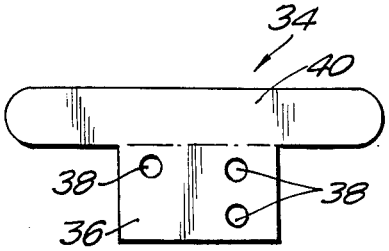
FIG. 3 is a plan view of one of the end stop members formed in a flat condition for subsequent bending.

In order to retain the insulation in place, stop members shown generally at 34 can be used. As shown in FIG. 3, the stop member 34 is stamped out of flat material and includes a substantially rectangular section 36 having a number of bores 38 formed therethrough, which bores correspond to aligned bores formed at the end of the web portion of the slat. Integrally connected with the rectangular section 36 is an elongated oval section 40 which serves as a closure member for closing off the end of the U-shaped channel of the slat.

When the stop members 34 are in the flat condition, as shown in FIG. 3, the rectangular section 36 is connected to the web by means of fastening members 42 such as rivets, screws, or the like. After such connection, the oval portion 40 is bent perpendicular to the web of the slat so as to form the stop edge of the slats, as shown in FIG. 2.

Figure 4:
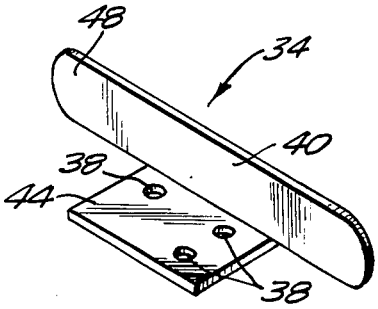
FIG. 4 is a perspective view of an end stop member formed into an L-shaped configuration.

As shown in FIG. 4, in an alternate method, the stop member 34 can be preformed in an L-shaped configuration before being connected to the slat. A first leg 44 thereof includes the rectangular section 36 with the bores 38 therein for connection to the web portion of the slat. The second leg 48 thereof includes the oval shaped elongated closure section 40 which serves as the stop for closing off the edge of the slats.

It should be appreciated, that when using the prior art insulation arrangements which slide into the slot channels, it is generally necessary to utilize the flat arrangement of the end closure, as shown in FIG. 3, so that this closure member can be bent in place after the insulation is added. However, it is obviously preferable to utilize the preformed type of stop member, as shown in FIG. 4, but the latter construction would prevent the sliding of the insulation into the slat channels.

As indicated in FIG. 2, not every slat need contain a stop member 34. For example, it may be desirable to stagger the stop members by placing one at one end of the slat and another at the opposing end of the next adjacent slat. However, occasionally the stop members could be placed at both opposing ends of each slat, depending upon the type of insulation being applied to the slats.

Figure 5:
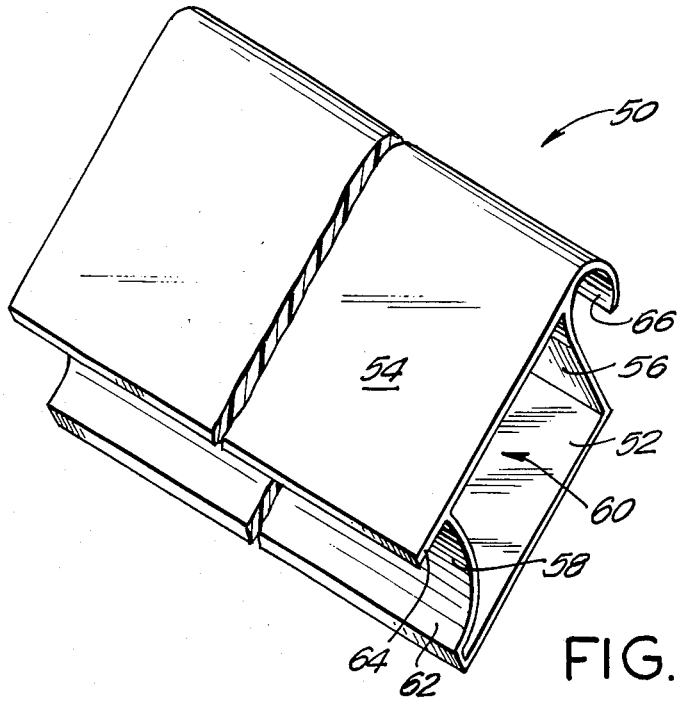
FIG. 5 is a perspective view of an insulation member for insertion co-extensively along a slat.

Referring now to FIG. 5, there is shown an improved insulation insert 50 which can be utilized for coextensive insertion against each individual slat. The insert 50 provides for the necessary insulation of each slat and can be assembled with the slats, as desired.

The insert 50 includes a substantially hollow sleeve having a front wall 52, a rear wall 54, and opposing side walls 56, 58. The hollow chamber 60 formed therein can receive insulation of various types, for example foam insulation, solid insulation, or other types of insulation including air. It should be appreciated, that the length of the insert 50 corresponds substantially to the length of the slats 12 and, accordingly, would extend the entire width of the roll-up door.

At the lower part of the forward wall 52 the insert 50 includes a foot portion 62. The side wall 58 is formed with an arcuate curvature which extends inwardly from the foot portion 62. At the rear wall 54, there is provided a cantilevered lip portion 64 on one side thereof, which extends outwardly from the arcuate side wall 58 to be over the foot portion 62. The lip portion 64 is resilient with respect to the insert sleeve. The other side of the rear wall 54 terminates in an arcuately downwardly curved hook portion 66 which extends downwardly toward the front wall 52 partway along the side wall 56.

Typically, the entire insert 50 can be formed of plastic material and integrally molded as a one piece construction. Accordingly, the resiliency of the lip 64 will be provided by the plastic material and the cantilevered construction of the lip which provides the necessary resiliency.

Figure 6:
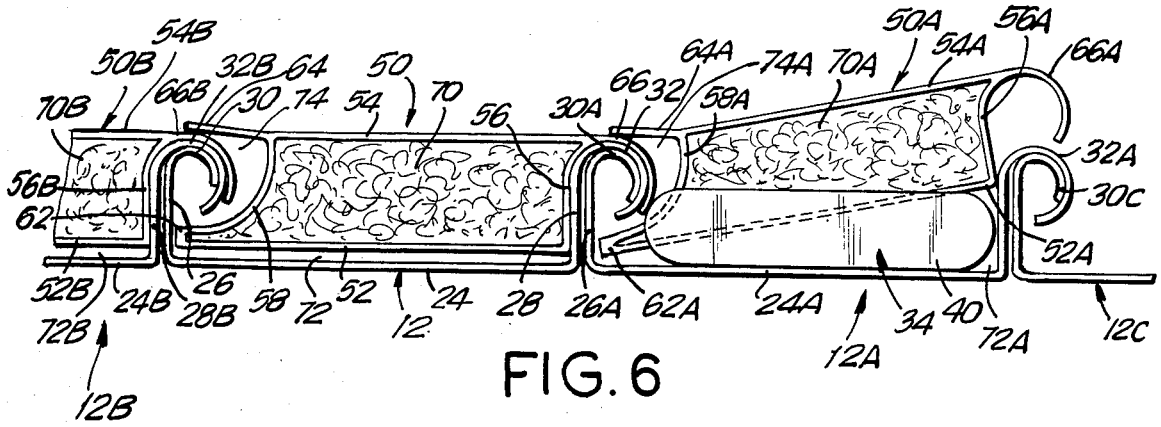
FIG. 6 is a cross sectional view taken through adjoining slats and showing the positioning of the insulation members against the slats.
Figure 7:
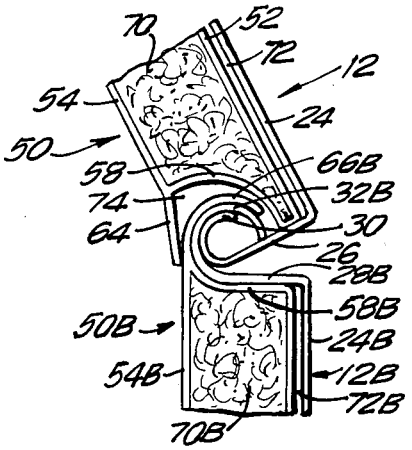
FIG. 7 is a fragmentary cross sectional view showing the hinged rotation of adjacent slats with the insulation members in place.

Referring now to FIGS. 6 and 7, there is shown the utilization of the inserts 50 in connection with the three slats 12, 12A, 12B which were heretofore shown in FIG. 2. Correspondingly, there are shown three inserts 50, 50A, and 50B, with each of the parts being correspondingly identified. With the insert 50 in place, its foot portion 62 is wedged against the flange 26 beneath the hinge connection including the hinge pin 30 of the slat 12 and the hinge barrel 32B of the next adjoining slat 12B. The lip portion 64 overlies the hinge connection 30, 32B, as well as the hook portion 66B of the next adjoining insert 50B. The hook portion 66 of the particular insert 50 overlies the entire hinge connection 32, 30A at the opposing side of the slat 12, and receives thereon the lip portion 64A of the next adjacent insert 50A.

Each of the inserts 50 can be assembled by sliding the insert along the slat until it is coextensive with the length of the slat 12, whereby the flat construction of the stop member 34 would be used. Alternately, the insert 50 can be positioned by first wedging the foot portion 62A in place, as shown in FIG. 6, and then snapping the hook portion 66A over the hinge connection 32A, 30C at the other side of the slat 12A. In this latter snap-in assembly, the preformed stop member 34 as shown in FIG. 4 can be used.

The arcuate wall 58 forms a recess for receiving the hinge arrangement which couples the adjoining slats, including the hook portion from the adjoining insert. By means of the arcuate recessed wall 58, the adjoining slats can be pivoted during the opening and closing of the door, as shown in FIG. 7. During this pivoting movement, the resilient lip portion 64 flexes to permit the pivotal movement of the slats with respect to each other, and also abuts against the hook portion from the adjoining insert to maintain the position of both adjacent inserts within their corresponding slats.

The insulation material 70 is shown as being inserted within the hollow chamber 60 of each sleeve insert 50, 50A and 50B. For additional insulation, it is noted that the thickness of the sleeve insert is less than the depth of the channel of each slat so as to define an air space 72 between the front wall 52 of the insert and the web portion 24 of the slat, where the lip portion in its abutting position keeps the insert front wall raised to maintain this air space. The air itself provides such additional insulation.

Further air insulation is provided by making the arcuate side wall 58 even further recessed than would be required to strictly accommodate for the pivotal movement of the adjoining slats. This recess defines an additional air space 74 between the arcuate recessed wall 58 and the adjacent hinge arrangement. The overlapping lip portion 64 further prevents any escape of insulating air that might seep through the hinge itself.

Figure 8:
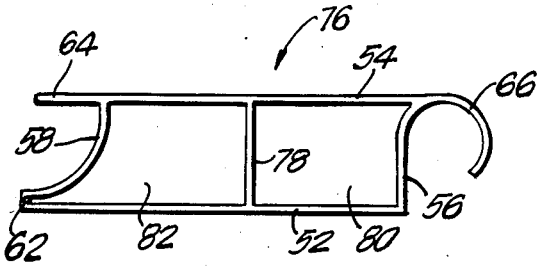
FIG. 8 is an end view of an insulation member in accordance with another embodiment of the present invention.

FIG. 8 shows another embodiment of the insert member 76 which includes a center wall 78 extending between the front wall 52 and the rear wall 54. The center wall 78 provides additional support for the insert member 76 and also defines opposing compartments 80, 82 on either side thereof for receiving the insulation material therein. Other parts of the insert member 76 are substantially identical to the insert 50 heretofore shown in FIG. 5.

With the use of the particular inserts 50, 76 heretofore described, which do not have to slide into the slats 12, it is possible to utilize the preformed L-shaped stop member hereto shown in FIG. 4. Of course, the flat type construction of the stop member shown in FIG. 3 could also be utilized.

With the use of the insertable insulation inserts 50, 76, it is possible to construct a roll-up door by assembling the slats together to the desired length and width as required. The insulation insert can then be either slid in place within the slats or snap-fit in place, and the proper L-shaped stop members can be used to retain the inserts within the slats. The inserts 50, 76 can also be removed when desired by either sliding them out or unsnapping them.

Furthermore, although the insulation insert is provided co-extensively within each slat, it should be appreciated that the use of the inserts in no way at all interferes with the pivotal operation of the slats so that the slats can continue to be moved between their closed position where they constitute a vertical planar arrangement, and the open position where they slide along the tracks into a recessed compartment for storage.

There has been disclosed heretofore the best embodiments of the invention presently contemplated. However, it is to be understood that various changes and modifications may be made thereto without departing from the spirit of the present invention.

What is claimed is:

1. A roll-up door comprising:

a plurality of elongated adjoining slats;

hinge means for coupling said adjoining slats together for relative movement of said slats between a vertical co-planar arrangement when the door is closed, and an arcuate arrangement when the door is being rolled up;

each of said slats including a U-shaped elongated channel having a web portion interconnecting inwardly directed opposed flange portions, said web portions of said slats cumulatively defining a front face of the door;

distal ends of said opposed flange portions of each slat terminating in forwardly directed arcuately curved first and second segments to define said hinge means;

said first segment on each slat having a curvature substantially concentric with and smaller than a curvature of said second segment on each respective slat;

said smaller first segment defining an elongated hinge pin for insertion into a hinge barrel of an adjoining slat on one side thereof;

said larger second segment defining an elongated hinge barrel for receiving a hinge pin of an adjoining slat on an opposite side thereof; and insertable and removable elongated insulation members being co-extensively disposed along each slat with each insulation member being positioned between said opposed flange portions of each respective slat;

each of said insulation members having a thickness from front to rear thereof less than depth of each of said U-shaped slat channels correspondingly from front to rear thereof so that said front of each of said insulation members is in a rearwardly spaced apart relationship to said web portion of each of said slats;

first and second support means on opposing sides of each of said insulation members for suspending each of said insulation members in said rearwardly spaced apart relationship to each of said slat web portions to provide an air space therebetween for additional insulation, said air space extending from one flange portion of each of said slats to the other flange portion of each of said slats;

said first support means including an elongated arcuate hook extending from a rear edge on one side of said insulation member for latching around an exterior of said elongated hinge barrel on each respective slat;

said second support means including an elongated lip resiliently projecting from said rear edge on the opposite side of said insulation member;

said elongated lip being in continuous engagement on an elongated hook of an adjoining insulation member for suspending said insulation member above said slat web portion of its respective slat;

said elongated hook of each insulation member securing and suspending said insulation member relative to its respective slat;

foot means for wedging against said one flange portion beneath said elongated hinge pin on each respective slat to retain said insulation members in its suspended position along said respective slats;

said foot means including an elongated foot projecting from a front edge on said opposite side of each insulation member;

said opposite side of each insulation member being provided with recess means between said lip and said foot for accommodating said elongated hinge barrel and elongated hook of its associated adjoining slat; and said recess means including an arcuate recess having a curvature extending from said foot to be concentric with an arc of rotation of said adjoining slats.

2. A roll-up door as in claim 1, wherein said insulation members include hollow sleeves for receiving insulation material therein.

3. A roll-up door as in claim 1, wherein said curved first and second segments extend only partially across said flange portions toward said web portion so that said first and second segments are spaced from said web portion.

4. A roll-up door as in claim 1, wherein said arcuate recess is greater than required to provide an air space for additional insulation.

5. A roll-up door as in claim 1, wherein each insulation member includes an elongated hollow sleeve having a substantially rectangular cross sectional configuration defined by front and back walls interconnected by opposing side walls and said elongated hook extending from a back edge of the other side wall.

6. A roll-up door as in claim 5, and further comprising an elongated intermediate wall extending between said front and back walls of said insulation member for additional support.

7. A roll-up door as in claim 1, wherein each insulation member is integrally molded of a plastic material.

8. A roll-up door as in claim 1, and comprising stop members connected to lateral ends of said slats to close off said slats for maintaining said insulation members along said slats.

9. A roll-up door as in claim 8, wherein said stop members includes two legs to provide an L-shaped configuration, one leg being secured onto said slat and the other leg closing off the lateral end of said slat.

10. A roll-up door as in claim 8, wherein each of said stop members is formed from a flat construction, one part of said stop member being secured onto a web portion of said slat and another part thereof being bent substantially perpendicular to said one part after securement to said web portion to close off the lateral end of said slat.

11. A roll up door as in claim 1, wherein associated portions of said hinge means are integral with each of said slats.

* * * * *